US007612117B2

(12) United States Patent
McDaniel et al.

(10) Patent No.: US 7,612,117 B2
(45) Date of Patent: Nov. 3, 2009

(54) EMULSION BREAKING PROCESS

(75) Inventors: Cato R. McDaniel, The Woodlands, TX (US); Alan E. Goliaszewski, The Woodlands, TX (US); David Birenbaum Engel, The Woodlands, TX (US)

(73) Assignee: General Electric Company, Schenectady, NY (US)

( * ) Notice: Subject to any disclaimer, the term of this patent is extended or adjusted under 35 U.S.C. 154(b) by 553 days.

(21) Appl. No.: 11/281,532

(22) Filed: Nov. 17, 2005

(65) Prior Publication Data

US 2007/0112079 A1 May 17, 2007

(51) Int. Cl.
*B01D 17/05* (2006.01)
*C10G 33/00* (2006.01)
*C10G 17/00* (2006.01)

(52) U.S. Cl. ..... 516/191; 208/180; 208/187

(58) Field of Classification Search ..... 516/191; 208/251 R, 180, 179, 181, 187, 254 R; 585/3
See application file for complete search history.

(56) References Cited

U.S. PATENT DOCUMENTS

| | | | | |
|---|---|---|---|---|
| 2,106,180 | A | 1/1938 | Kreimeier | |
| 2,163,720 | A | 1/1939 | Vaughn | |
| 2,250,445 | A | 7/1941 | Bruson et al. | |
| 3,280,035 | A * | 10/1966 | Bonner | 508/583 |
| 3,779,935 | A | 12/1973 | McDougall et al. | |
| 4,053,422 | A * | 10/1977 | Walker | 507/109 |
| 4,401,584 | A * | 8/1983 | Tajkowski et al. | 252/194 |
| 4,431,524 | A * | 2/1984 | Norman | 208/183 |
| 4,432,865 | A * | 2/1984 | Norman | 208/183 |
| 4,477,286 | A | 10/1984 | Rossmann et al. | |
| 4,522,658 | A | 6/1985 | Walker | |
| 4,780,223 | A | 10/1988 | Roe | |
| 5,079,036 | A | 1/1992 | Roe et al. | |
| 5,080,779 | A | 1/1992 | Awbrey et al. | |
| 5,114,607 | A | 5/1992 | Deck et al. | |
| 5,120,708 | A * | 6/1992 | Melear et al. | 507/126 |
| 5,127,993 | A | 7/1992 | Chen | |
| 5,190,105 | A | 3/1993 | D'Souza | |
| 5,256,305 | A | 10/1993 | Hart | |
| 5,256,329 | A * | 10/1993 | Li et al. | 252/194 |
| 5,324,770 | A | 6/1994 | Cosper, III | |
| 5,622,921 | A | 4/1997 | Dyer | |
| 5,650,543 | A | 7/1997 | Medina | |
| 6,017,368 | A | 1/2000 | Steinmann | |
| 6,313,182 | B1 | 11/2001 | Lassila et al. | |
| 6,641,986 | B1 | 11/2003 | Zhang et al. | |
| 6,864,395 | B2 | 3/2005 | Lassila et al. | |
| 7,497,943 | B2 * | 3/2009 | Nguyen et al. | 208/251 R |
| 2007/0111903 | A1 * | 5/2007 | Engel et al. | 507/261 |

FOREIGN PATENT DOCUMENTS

| | | | |
|---|---|---|---|
| CA | 2 478 622 | * | 5/2005 |
| EP | 0 192 130 | A2 | 8/1986 |
| SU | 1532573 | A1 * | 12/1989 |

OTHER PUBLICATIONS

Derwent Abstract, week 199028, London: Derwent Publications Ltd., AN 1990-215808, SU 1532573 A1, (Moscow Gubkin Petrochem), abstract.*
Air Products Material Safety Data Sheet; MSDS No. 300000004774; Oct. 30, 2005; Version 1.9.

* cited by examiner

*Primary Examiner*—Daniel S Metzmaier
(74) *Attorney, Agent, or Firm*—Wegman, Hessler & Vanderburg

(57) ABSTRACT

The invention pertains to the use of a class of acetylenic surfactants to resolve or break water and oil emulsions. The surfactants are of particular advantage in resolving crude oil emulsions of the type encountered in desalter and similar apparatus designed to extract brines from the crude as they partition to the aqueous phase in the desalter.

22 Claims, No Drawings

EMULSION BREAKING PROCESS

FIELD OF INVENTION

The invention pertains to methods for resolving or breaking various oil and water emulsions by the use of certain classes of acetylenic surfactants. These surfactants may be used by themselves, or optionally, they can be conjointly used with additional surfactants in resolving the emulsions.

BACKGROUND OF THE INVENTION

All crude oil contains impurities which contribute to corrosion, heat exchanger fouling, furnace coking, catalyst deactivation, and product degradation in refinery and other processes. These contaminants are broadly classified as salts, bottom sediment, and water (BS+W), solids, and metals. The amounts of these impurities vary, depending upon the particular crude. Generally, crude oil salt content ranges between about 3-200 pounds per 1,000 barrels (ptb).

Native water present in crude oils includes predominately sodium chloride with lesser amounts of magnesium chloride and calcium chloride being present. Upon thermal hydrolysis, chloride salts are the source of highly corrosive HCl, which is severely damaging to refinery tower trays and other equipment. Additionally, carbonate and sulfate salts may be present in the crude in sufficient quantities to promote crude preheat exchanger scaling.

Solids other than salts are equally harmful. For example, sand, clay, volcanic ash, drilling muds, rust, iron sulfide, metal, and scale may be present and can cause fouling, plugging, abrasion, erosion and residual product contamination. As a contributor to waste and pollution, sediment stabilizes emulsions in the form of oil-wetted solids and can carry significant quantities of oil into the waste recovery systems.

Metals in crude may be inorganic or organometallic compounds which consist of hydrocarbon combinations with arsenic, vanadium, nickel, copper, iron, and other metals. These materials promote fouling and can cause catalyst poisoning in subsequent refinery processes, such as catalytic cracking methods, and they may also contaminate finished products. The majority of the metals carry as bottoms in refinery processes. When the bottoms are fed, for example, to coker units, contamination of the end-product coke is most undesirable. For example, in the production of high grade electrodes from coke, iron contamination of the coke can lead to electrode degradation and failure in processes, such as those used in the chlor-alkali industry.

Desalting is, as the name implies, a process that is adapted (although not exclusively) to remove primarily inorganic salts from the crude prior to refining. The desalting step is provided by adding and mixing or emulsifying with the crude a few volume percentages of fresh water to contact the brine and salt. In crude oil desalting, a water in oil (W/O) emulsion is intentionally formed with the water admitted being on the order of about 3-10 volume % based on the crude oil. Water is added to the crude and mixed intimately to transfer impurities in the crude to the water phase. Separation of the phases occurs due to coalescence of the small water droplets into progressively larger droplets and eventual gravity separation of the oil and underlying water phase.

Demulsification agents are added, usually upstream from the desalter, and have a variety of purposes such as to help in providing maximum mixing of the oil and water phases, dehydrate the crude oil, provide faster water separation, better salt extraction or improved solids extraction and generate oil-free effluent water. Known demulsifying agents include water soluble organic salts, sulfonated glycerides, sulfonated oils, acetylated caster oils, ethoxylated phenol formaldehyde resins, polyols, polyalkylene oxides, ethoxylated amines, a variety of polyester materials, and many other commercially available compounds.

Desalters are also commonly provided with electrodes to impart an electrical field in the desalter. This serves to polarize the dispersed water molecules. The so-formed dipole molecules exert an attractive force between oppositely charged poles with the increased attractive force increasing the speed of water droplet coalescence by from ten to one hundred fold. The water droplets also move quickly in the electrical field, thus promoting random collisions that further enhance coalescence.

Upon separation of the phases from the W/O emulsions, the crude is commonly drawn off the top of the desalter and sent to the fractionator tower in crude units or other refinery processes. The water phase may be passed through heat exchanges or the like and ultimately is discharged as effluent.

In addition to the need for effective emulsion breakers in resolving the W/O emulsions in desalters and the like, W/O emulsions are also commonly employed in certain bitumen demulsification processes. The emulsions encountered can be of the oil in water type, wherein the density of the hydrocarbon materials is greater than that of water. In these cases, the hydrocarbon phase can be taken from the bottom of the vessel used for separation.

Emulsions are also formed during the production of crude oil. Water is associated with the geological formation and will be co-produced from the oil well. Also, water or steam may be added to the formation in enhanced oil recovery operations that will contribute water to the produced oil stream. Turbulence applied by choke points in the wellhead or production adds sufficient mechanical force to create an emulsion from the oil/water mixture. This water needs to be separated from the produced oil, as pipeline and other collection or transportation systems have specs on maximum amounts of water that can be associated with the oil. The water can lead to corrosion issues in the pipeline. Emulsion breakers are applied to speed the separation of the oil and water during production. Various types of equipment have been used to effect this separation such as dehydrators or heat treaters.

Emulsions that become difficult to break or resolve as a result of refinery reworks, tankwashes, interfaces and others are often referred to as "slop". This "slop" cannot be discharged directly due to environmental concerns so that it has therefore become important to efficiently resolve or separate the emulsion constituents into an oleaginous (oil) phase and a combined mud/non-oleaginous (i.e.) water phase. The oil phase may be used as a process fluid for refinery or other processes or recycled for down hole usage. The mud/water phase may be sent to further separation processes to separate the water for discharge or other use and the mud for possible recycling into down hole operations. Additionally, in some cases, the drilling mud actually seeps out of formation into the crude oil that is being extracted to form an undesirable drilling mud emulsion containing crude oil, water, and sometimes clay as components.

Accordingly, there is a need in the art to provide effective demulsifying treatments to resolve or break water and oil emulsions, particularly the crude oil emulsions encountered in desalter apparatuses, water and bitumen emulsions, and drilling mud emulsions. The emulsions may also be encountered in heat treaters, free water knockout apparatus, inclined plate separation apparatus, water separation apparatus, hydrocyclones, and centrifuges.

SUMMARY OF THE INVENTION

The invention pertains to the use of a class of acetylenic surfactants to resolve or break water and oil emulsions. The surfactants are of particular advantage in resolving crude oil emulsions of the type encountered in desalter, oil field dehydration vessels, and similar apparatus designed to extract brines from the crude as they partition to the aqueous phase in the desalter. Although the invention is of particular advantage in the breaking or resolution of O/W emulsions, it may also be successfully employed in the resolution of W/O type emulsions.

More specifically, the acetylenic surfactant is a member or members from the groups represented by the Formulae Ia and Ib wherein, Formula Ia is Ia

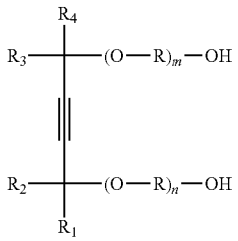

and wherein Ib is

Ib

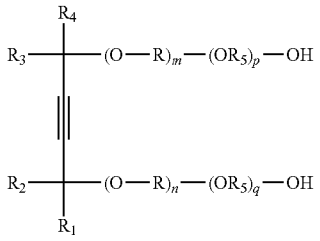

wherein in Formulae Ia and Ib R is —($CH_2$—$CH_2$)—; $R_5$ is —($CH_2$($CH_3$)CH)— or —($CH_2$—$CH_2$—$CH_2$)—; $R_1$ and $R_4$ are a straight or a branched chain alkyl having from about 3 to 10 C atoms or an aryl group; $R_2$ and $R_3$ are H, an alkyl chain having 1 to 5 C atoms, or an aryl group, and m, n, p, and q are numbers that range from about 0 to about 30.

DETAILED DESCRIPTION OF EXEMPLARY EMBODIMENTS

Although the present invention is primarily described in conjunction with the resolution of a crude oil/water emulsion in a conventional desalter or the like or in an oilfied dehydration vessel, the artisan will appreciate that in a broader sense, the invention is applicable to resolution of a variety of oil and water emulsions. For example, emulsions encountered in the storage and processing of a variety of liquid hydrocarbon media including vacuum residia, solvent deasphated oils, gas oils, gasolines, diesel fuel, shale oil, liquefied coal, beneficiated tar sand, bitumen, etc., may all be treated in accordance with the invention.

The acetylenic surfactants Ia, Ib may be added to either the oil phase, the water phase, or the emulsion itself. Either way, the surfactant Ia, Ib must be brought into contact with the emulsion so as to promote mixing therewith to effectively perform its intended function as an emulsion breaker. As used herein, the surfactant is said to be brought into contact with the emulsion. This means that the surfactant can be added to either the hydrocarbon phase, the water phase, or the formed emulsion itself. Under all of these conditions, the surfactant ultimately contacts the emulsion. In one exemplary embodiment of the invention, the surfactant Ia, Ib is intimately and thoroughly mixed with the wash water that is fed into the desalter to thereby mix with and contact the emulsion.

As stated above, these acetylenic functional surfactants have the Formula Ia or Ib wherein Ia is Ia

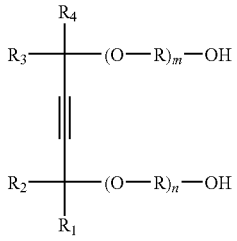

and wherein Ib is

Ib

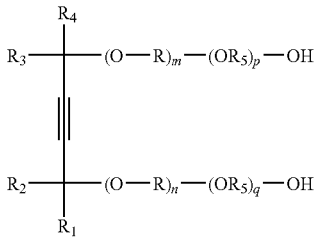

wherein R is —($CH_2$—$CH_2$)—; $R_5$ is —($CH_2$($CH_3$)CH)— or —($CH_2$—$CH_2$—$CH_2$)—; $R_1$ and $R_4$ are a straight or a branched chain alkyl having from about 3 to 10 C atoms or an aryl group; $R_2$ and $R_3$ are H, an alkyl chain having 1 to 5 C atoms, or an aryl group, and m, n, p, and q are numbers that range from about 0 to about 30.

Surfactants of the classes Ia and Ib are commercially available from Air Products Inc., Allentown, Pa., under a variety of "Sulfonyl", "Dynol", and "Envirogem" trademark designations and are described in the literature as being non-ionic surfactants based on acetylenic diol chemistry. Available products includes ethoxylated and ethoxylated/propoxylated versions of the diols. Commercially available products include:

(1) 2,4,7,9-tetramethyl-5-decyne-4,7 diol (TMDD-5)

(2) 2,5,8,11-tetramethyl-6-dodecyne-5,8 diol (TMDD-6)

(3) (TMDD-5)-1.3 mole ethoxylate (4) (TMDD-5)-3.5 mole ethyoxylate (5) (TMDD-5)-5.1 mole ethoxylate (6) (TMDD-5)-10.0 mole ethoxylate (7) (TMDD-5)-30.0 mole ethoxylate (8) (TMDD-6)-4.0 mole ethyoxylate (9) (TMDD-5)-5 mole ethoxylate/2 mole propoxylate; m+n in Formula Ib =5 and p and q =2.

With regard to the diol surfactants (i.e., those in Formula Ia wherein m and n are both zero), these are, as stated above, commercially available and can be made via the techniques reported in U.S. Pat. Nos. 2,250,445; 2,106,180; and 2,163,720, all of which are incorporated by reference herein. In summary of these disclosures, these tertiary acetylenic diols may be formed via mixing of a saturated ketone with an alkali metal hydroxide, and the resulting mixture is then reacted with acetylene. This results in production of the acetylenic monohydroxide product and, more importantly, the geminate acetylenic glycol.

The tertiary acetylenic diols, preferably (TMDD-5) and (TMDD-6) are then used as the precursors to form the EO and/or EO/PO adducts in accord with the procedures set forth for example in U.S. Pat. Nos. 6,313,182 and 6,864,395; both of which are incorporated by reference herein. As aforementioned, both the EO and EO/PO derivatives are also commercially available. Briefly, the procedures reported in these patents involve reaction of the precursor with the requisite quantities of EO and/or EO followed by PO in the presence of a suitable catalyst including trialkylamines and Lewis acids, particularly $BF_3$. Also, the compositions may be prepared by reaction of a pre-formed acetylenic diol ethyoxylate with PrO in the presence of a catalyst.

Similarly, aromatic compounds can be made wherein some or all of the $R_1$-$R_4$ groups may independently comprise an aryl moiety. For example, 2,4, dimethhyl-7-phenyl-5 octyne-4,7-diol was made via the following process:

To a solution of 12.6 (0.1 mol) g of 3,4-dimethyl-1-hexyn-3-ol in 500 mL in diethyl ether at 0° C. was added drop wise a solution of n-BuLi (2.0 M, 110 mL, 0.22 mols) over a period of 1 hour. The reaction mixture was stirred for an additional 30 minutes, treated with a solution of acetophenone (12 g, 0.1 mol) in 100 mL ether and allowed to warm to room temperature. The solution was quenched with 600 mL of a 0.1 N HCl solution, and the organic phases separated. The aqueous phase was further extracted with ether (3×100 ml), and the combined organic phases were washed with saturated $NaHCO_3$ solution (3×100 mL), water (2×100 mL) and dried over molecular sieves.

From about 1 to 500 ppm of the acetylenic surfactants from the groups Ia and/or Ib are added to make contact with the emulsion based on one million parts of the emulsion. At present, it is preferred to add the surfactant to either the water wash flowing into the desalter, to the crude oil stream or directly to the emulsion so as to ensure thorough mixing of the surfactant with the emulsion.

In addition to the acetylenic surfactants Ia and Ib, additional surfactants may be added to contact and aid in resolution of the emulsion. These additional surfactants II include polyols, EP/PO polymers, alkylphenolformaldehyde resin ethoxylates, ethoxylated amines, ethoxylated polyamines, alkylphenolethoxylates, aromatic sulfonates, and sulfo succinates. These additional surfactants II may also be added in necessary amounts so that the total surfactant I or I and II present to contact the emulsion is from about 1 to about 1,000 ppm based on one million parts of the emulsion.

In those instances in which the surfactants I and II are conjointly used, they may be present in the following weight percentage range, based on 100 wt % of the combination: I:II of about I 1-90%:II 99 wt %-10 wt %.

One particular class of additional surfactants (II) has shown enhanced efficacy in preliminary tests when used conjointly with the surfactant I. Specifically, this surfactant (II) is chosen from EO/PO polymers having the Formula II:

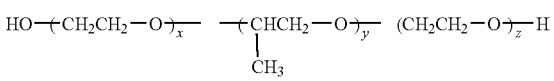

II wherein x, y, and z are each at least 1 and are such as to provide the compound with a molecular weight of about 500 or higher.

Block copolymers in accordance with Formula II preferably have molecular weights of from about 500 to 30,000 with a molecular weight of about 1,000-10,000 being more preferred. Preferred are those block copolymers wherein the combined EtO moieties comprise about 20-80% by weight of the surfactant (II). These preferred surfactants II are available from BASF under the "Pluronic" designation. Most preferred is a block copolymer wherein the EtO moieties make up about 40% by weight of the polymer, and the overall mw of the block copolymer is about 4,000.

One particularly preferred conjoint treatment is Ia-(TMDD-5) with II EO/PO block copolymer-P-84. The (TMDD-5) is present in an amount of about 1-50% of the conjoint treatment, more preferably in an amount of about 1-20% by weight.

The invention will now be further described in conjunction with the following examples which are illustrative of a variety of exemplary embodiments of the invention and should not be used to narrowly construe same.

EXAMPLES

In order to assess the emulsion breaking efficacy of candidate materials, simulated desalter tests were undertaken. The simulated desalter comprises an oil bath reservoir provided with a plurality of test cell tubes dispersed therein. The temperature of the oil bath can be varied to about 300° F. to simulate actual field conditions. The test cells are placed into an electrical field to impart an electrical field able potential through the test emulsions.

Example 1

97 ml of crude oil along with 3 ml of D.I. water were admitted to each test cell along with the candidate emulsion breaker materials. The crude/water/treatment mixtures were homogenized by mixing each of the test cell tubes at 13,000 rpm for 2 seconds. The test cell tubes were heated to about 250° F. Water drop (i.e., water level) in ml was observed for each sample after the predetermined time intervals according to the schedule. Results are shown in Table 1.

TABLE 1

| Treatment | ppm | 1 min | 2 min | 4 min | 8 min | 16 min | 32 min | 64 min | Sum | I/F |
|---|---|---|---|---|---|---|---|---|---|---|
| Blank | 0 | 0 | 0 | 0.1 | 0.1 | 0.2 | 0.2 | 0.2 | 0.8 | .4 IF |
| 1 | 0.5 | 0 | 0.2 | 0.4 | 0.8 | 1.6 | 2 | 2.25 | 7.25 | |

TABLE 1-continued

| Treatment | ppm | 1 min | 2 min | 4 min | 8 min | 16 min | 32 min | 64 min | Sum | I/F |
|---|---|---|---|---|---|---|---|---|---|---|
| 1 | 2 | 0 | 0.2 | 0.8 | 1.4 | 2 | 2.5 | 2.5 | 9.4 | |
| 1 | 5 | 0 | 0.1 | 1.4 | 1.8 | 2.8 | 3 | 3 | 12.1 | |
| 1 | 10 | 0 | 0.1 | 0.8 | 1.6 | 2.4 | 2.5 | 3 | 10.4 | |
| 2W157 | 1 | 0 | 0 | 0.4 | 0.6 | 1 | 1.8 | 2 | 5.8 | |
| 2W157 | 5 | 0 | 0 | 1.4 | 1.6 | 2 | 3 | 3 | 11 | |
| 2W157 | 10 | 0 | 0 | 1 | 1.4 | 2 | 2.5 | 2.5 | 9.4 | |
| Blank | 0 | 0 | 0.2 | 0.8 | 1 | 1.4 | 2 | 2 | 7.4 | .3 IF |
| 1 | 0.5 | 0 | 0.2 | 2.2 | 3 | 4 | 4 | 5 | 18.4 | |
| 1 | 2 | 0 | 0.1 | 2.5 | 4 | 4.5 | 5 | 5 | 21.1 | |
| 1 | 5 | 0 | 0.1 | 1.8 | 3 | 3.5 | 4 | 4.5 | 16.9 | |
| 1 | 10 | 0 | 0.2 | 1.4 | 2 | 2.5 | 3 | 3.5 | 12.6 | |
| 2W157 | 1 | 0 | 0.2 | 2 | 3 | 3.5 | 4 | 4.5 | 17.2 | |
| 2W157 | 5 | 0 | 0.2 | 2.5 | 3.5 | 4.5 | 5 | 5 | 20.7 | |
| 2W157 | 10 | 0 | 0.2 | 2.5 | 4 | 4 | 4.5 | 4.5 | 19.7 | |
| Blank | 0 | 0 | 0.2 | 1 | 2 | 2.5 | 3 | 4 | 12.7 | 0.3 |
| P-84 | 5 | 0 | 0.4 | 1.4 | 2 | 3 | 3.5 | 5 | 15.3 | |
| 2 | 5 | 0 | 0.4 | 3 | 3.5 | 4 | 4.5 | 5 | 20.4 | |
| 5 | 5 | 0 | 0.4 | 3 | 3.5 | 3.5 | 4 | 5 | 19.4 | 0.5 |
| 3 | 5 | 0 | 0.4 | 2.5 | 3 | 3.5 | 4.5 | 4.5 | 18.4 | |
| 4 | 5 | 0 | 0.2 | 1.8 | 3 | 3.5 | 3.5 | 4 | 16 | 0.5 |
| Span 80 | 5 | 0 | 0.2 | 0.8 | 3 | 3.5 | 4 | 4 | 15.5 | 1 |
| 2 | 1 | 0 | 0 | 2 | 3.5 | 4 | 4 | 5 | 18.5 | |

ppm = parts per million of treatment based on 1 million parts of combined crude oil and water.
Treatment 1 = combination of a) (TMDD-5)- and b) ethoxylated alkyl phenol
Treatment 2 = combination of a) (TMDD-5)- and c) triblock copolymer $[(PEO)_{19}(PPO)_{43}(PEO)_{19}]$ wherein a is present in amount of 3 wt % remainder c.
Treatment 3 = (TMDD-5)- 1.3 mole ethoxylate
Treatment 4 = (TMDD-5)- 3.5 mole ethoxylate
Treatment 5 = (TMDD-5) - ethoxylated - surfynol DF-37- Air Products
2W157 = emulsion breaker; available GE Betz
P-84 = triblock copolymer $[(PEO)_{19}(PPO)_{43}(PEO)_{19}]$
Span 80 = sorbitan oleate

Example 2

Another series of tests was performed using the simulated desalter apparatus described in Example 1. In this series of test, 95 ml of crude oil and 5 ml of D.I. water plus treatment were added to the test cells. Results are shown in Table 2.

TABLE 2

| Treatment | Ppm | 1 min | 2 min | 4 min | 8 min | 16 min | 32 min | Sum |
|---|---|---|---|---|---|---|---|---|
| Blank | 0 | 0 | 0.2 | 1.4 | 2 | 2.5 | 4.5 | 10.6 |
| 2W157 | 5 | 0 | 2 | 3 | 4.5 | 5 | 5 | 19.5 |
| 6 | 5 | 0 | 0.4 | 2 | 2.5 | 2.5 | 3 | 10.4 |

TABLE 2-continued

| Treatment | Ppm | 1 min | 2 min | 4 min | 8 min | 16 min | 32 min | Sum |
|---|---|---|---|---|---|---|---|---|
| P-84 | 5 | 0 | 1 | 2.5 | 3 | 4 | 5 | 15.5 |
| 2 | 5 | 0 | 2.5 | 4.5 | 4.8 | 5 | 5 | 21.8 |

Treatment 6 = (TMDD-5)-

Example 3

Another test series was undertaken to assess the efficacy of candidate materials in breaking bitumen emulsions. These tests were similar to those reported in Example 1 with exceptions noted in the table and the fact that an electrical field was not imparted to the test emulsions. Results are reported in Table 3.

TABLE 3

| | Ratio of bitumen emulsion to diluent 80%::20% Conditions: Blended at 10,000 rpm for THREE seconds Grids off | | | | | | | | |
|---|---|---|---|---|---|---|---|---|---|
| | Amount of emulsion remaining after | | | | | | | | Diluent + mL |
| Treatment | ppm | 1 min | 2 min | 4 min | 8 min | 16 min | 32 min | sum | Oil recovered |
| Blank | 0 | 80 | 80 | 80 | 80 | 80 | 80 | 480 | 0 |
| 2W157 | 500 | 50 | 50 | 50 | 50 | 50 | 50 | 300 | 180 |
| 7 | 500 | 45 | 48 | 48 | 50 | 50 | 50 | 291 | 189 |
| 8 | 500 | 80 | 80 | 80 | 60 | 70 | 65 | 435 | 45 |
| 9 | 500 | 53 | 53 | 54 | 52 | 54 | 54 | 320 | 160 |
| 10 | 500 | 80 | 80 | 80 | 60 | 70 | 63 | 433 | 47 |

TABLE 3-continued

| | Ratio of bitumen emulsion to diluent 80%::20% Conditions: Blended at 10,000 rpm for THREE seconds Grids off | | | | | | | | |
|---|---|---|---|---|---|---|---|---|---|
| | Amount of emulsion remaining after | | | | | | | | Diluent + mL |
| Treatment | ppm | 1 min | 2 min | 4 min | 8 min | 16 min | 32 min | sum | Oil recovered |
| 11 | 500 | 50 | 50 | 50 | 50 | 55 | 58 | 313 | 167 |
| 12 | 500 | 45 | 47 | 47 | 47 | 47 | 47 | 280 | 200 |

Without treatment, the bitumen emulsion was completely unbroken under the conditions used.
Treatment 7 = combination of a) TMDD-5 and b) PEO/PPO block copolymer, PEO = 40 molar %; mw ≈ 4,000; a) is present in amount of 5 wt %; remainder b)
Treatment 8 = combination of a) TMDD-5 and b) PEO/PPO block copolymer, PEO = 30 molar %, mw ≈ 4,000; a) is present in an amount of 5 wt %; remainder b)
Treatment 9 = combination of a) TMDD-5 and b) PEO/PPO block copolymer, PEO = 40 molar %; mw ≈ 4,000; a) is present in an amount of 10 wt %; remainder b)
Treatment 10 = combination of a) TMDD-5 and b) PEO/PPO block copolymer, PEO = 30 molar %, mw ≈ 4,000; a) is present in an amount of 10 wt %; remainder b)
Treatment 11 = combination of a) TMDD-5 and b) PEO/PPO block copolymer, PEO = 50 molar %, mw ≈ 5,000; a) is present in an amount of 20 wt %, remainder b)
Treatment 12 = combination of a) TMDD-5 and b) PEO/PPO block copolymer; PEO = 40 molar %, mw ≈ 4,000; a) is present in an amount of 20 wt %, remainder b).

While this invention has been described with respect to particular embodiments thereof, it is apparent that numerous other forms and modifications thereof will be obvious to those skilled in the art. The appended claims generally should be construed to cover all such obvious forms and modifications which are within the true spirit and scope of the present invention.

What is claimed is:

1. A method of resolving a crude oil containing emulsion that includes an oil phase and an aqueous phase comprising contacting said crude oil emulsion with an amount of between about 1 to 1,000 ppm of an acetylenic surfactant compound or compounds selected from the groups Ia and Ib, wherein said Group Ia has the formula Ia

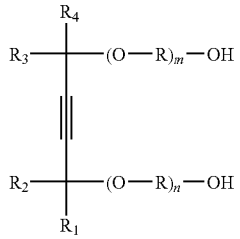

and wherein said Group Ib has the formula

Ib

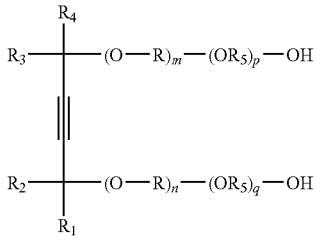

wherein R is —($CH_2$—$CH_2$)—; $R_5$ is —($CH_2$($CH_3$)CH)—or —($CH_2$—$CH_2$—$CH_2$)—; $R_1$ and $R_4$ are a straight or a branched chain alkyl having from about 3 to 10 C atoms or an aryl group; $R_2$ and $R_3$ are H, an alkyl chain having 1 to 5 C atoms or aryl group, and m, n, p, and q are numbers that range from about 0 to about 30, said method further comprising contacting said crude oil emulsion with another surfactant (II) wherein said surfactant (II) is a polyol having the formula

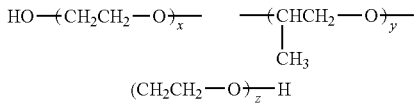

wherein the moieties x, y, and z are each at least 1 and are such as to provide the compound with a molecular weight of about 500 or higher.

2. Method as recited in claim 1 wherein said emulsion is formed in a desalting apparatus.

3. Method as recited in claim 1 wherein said emulsion is a bitumen emulsion.

4. Method as recited in claim 1 wherein said emulsion is a slop oil emulsion.

5. Method as recited in claim 1 wherein said emulsion comprises water, oil, and sand.

6. Method as recited in claim 1 wherein said emulsion is located in a heater treater apparatus, free water knockout apparatus, inclined plate separator apparatus, or a water separator apparatus.

7. Method as recited in claim 1 wherein said emulsion is located in hydrocyclone or centrifuge.

8. Method as recited in claim 1 wherein said emulsion is a drilling mud emulsion.

9. Method as recited in claim 8 wherein said drilling mud emulsion is an inverted slop oil drilling mud emulsion.

10. Method as recited in claim 8 wherein said drilling mud emulsion results from leakage of drilling mud into produced crude oil.

11. Method as recited in claim 1 wherein said emulsion is a refinery slop oil emulsion.

12. Method as recited in claim 1 wherein said surfactant compound or compounds are chosen from the group consisting of a) 2, 4, 7, 9-tetramethyl-5-decyne-4,7-diol (TMDD-5) and b) 2, 5, 8, 11-tetramethyl-6-dodecyne-5,8-diol (TMDD-6) and ethoxylates and propylene oxide derivations of a) and b).

13. Method as recited in claim 12 wherein said surfactant compound is a).

14. Method as recited in claim 12 wherein said surfactant compound is an ethoxylate or propylene oxide capped ethoxylate of a).

15. Method as recited in claim 1 wherein said additional surfactant (II) has a molecular weight of from about 500 to about 30,000.

16. Method as recited in claim 15 wherein said x and z moieties of said additional surfactant (II) comprise about 20%-80% by weight of said additional surfactant.

17. Method as recited in claim 16 wherein said x and z moieties comprise about 40 percent by weight of said additional surfactant and said additional surfactant has a molecular weight of about 4,000.

18. Method as recited in claim 1 wherein said surfactant Ia, Ib, and II is brought into contact with said emulsion in a combined amount of 1 to 1,000 ppm based upon one million parts of said emulsion, and wherein said surfactant Ia, Ib is present in an amount of about 1-90 wt % based on the total weight of La, Ib, and II.

19. A method of breaking a bitumen emulsion comprising contacting said bitumen emulsion with an effective amount of between about 1 about 500 ppm of an acetylenic surfactant compound or compounds selected from the groups Ia and Ib, wherein said Group Ia has the formula Ia

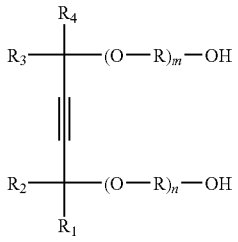

and wherein said Group lb has the formula

Ib

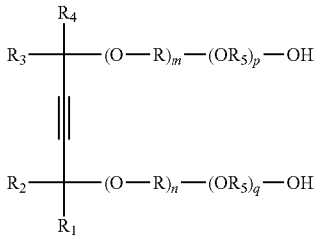

wherein R is —($CH_2$—$CH_2$)—; $R_5$ is —($CH_2(CH_3)CH$)— or —($CH_2CH_2CH_2$)—; $R_1$ and $R_4$ are a straight or a branched chain alkyl having from about 3 to 10 C atoms or an aryl group; $R_2$ and $R_3$ are H, an alkyl chain having 1 to 5 C atoms or aryl group, and m, n, p, and q are numbers that range from about 0 to about 30, and an additional surfactant II comprising a polyol having the formula

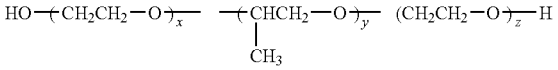

wherein the moieties x, y, and z are each at least 1 and are such as to provide the compound with a molecular weight of about 500 or higher, said I and II in combination, being present in an amount of from about 1 to 1,000 ppm based upon one million parts of said emulsion.

20. Method as recited in claim 19 wherein said surfactant compound or compounds Ia or lb are chosen from the group consisting of a) 2, 4, 7, 9-tetramethyl-5-decyne-4,7-diol (TMDD-5) and b) 2, 5, 8, 11-tetramethyl-6-dodecyne-5,8-diol (TMDD-6) and ethoxylates and propylene oxide derivations of a) and b), and wherein said surfactant II has a molecular weight of from about 500 to about 30,000.

21. Method as recited in claim 20 wherein said x and z moieties of said additional surfactant (II) comprise about 20%-80% by weight of said additional surfactant.

22. Method as recited in claim 21 wherein said x and z moieties comprise about 40 percent by weight of said additional surfactant and said additional surfactant has a molecular weight of about 4,000.

* * * * *

UNITED STATES PATENT AND TRADEMARK OFFICE

CERTIFICATE OF CORRECTION

PATENT NO. : 7,612,117 B2
APPLICATION NO. : 11/281532
DATED : November 3, 2009
INVENTOR(S) : McDaniel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 904 days.

Signed and Sealed this

Nineteenth Day of October, 2010

David J. Kappos

David J. Kappos
*Director of the United States Patent and Trademark Office*